US008274230B2

(12) United States Patent
Chiu

(10) Patent No.: US 8,274,230 B2
(45) Date of Patent: Sep. 25, 2012

(54) LED LAMP APPARATUS AND METHOD FOR ADJUSTING COLOR TEMPERATURE OF LED MODULE THEREIN

(75) Inventor: Hua-Jung Chiu, Taoyuan County (TW)

(73) Assignee: Davinci Industrial Inc., Taipei Hsien (TW)

( * ) Notice: Subject to any disclaimer, the term of this patent is extended or adjusted under 35 U.S.C. 154(b) by 379 days.

(21) Appl. No.: 12/732,455

(22) Filed: Mar. 26, 2010

(65) Prior Publication Data

US 2011/0234109 A1 Sep. 29, 2011

(51) Int. Cl.
*H05B 37/02* (2006.01)

(52) U.S. Cl. ..... 315/185 R; 315/297; 315/308

(58) Field of Classification Search ..... 315/185 R, 315/186, 192, 291, 293, 294, 297, 307–309
See application file for complete search history.

(56) References Cited

U.S. PATENT DOCUMENTS

| | | | | |
|---|---|---|---|---|
| 2008/0203945 | A1* | 8/2008 | Deurenberg et al. | 315/307 |
| 2008/0309255 | A1* | 12/2008 | Myers et al. | 315/297 |
| 2011/0037388 | A1* | 2/2011 | Lou et al. | 315/35 |
| 2011/0175528 | A1* | 7/2011 | Rains et al. | 315/51 |
| 2011/0204778 | A1* | 8/2011 | Sadwick et al. | 315/34 |
| 2011/0309754 | A1* | 12/2011 | Ashdown et al. | 315/151 |
| 2012/0001569 | A1* | 1/2012 | Christoph et al. | 315/294 |
| 2012/0049745 | A1* | 3/2012 | Li et al. | 315/153 |

* cited by examiner

*Primary Examiner* — Don Le
(74) *Attorney, Agent, or Firm* — Rosenberg, Klein & Lee

(57) ABSTRACT

A light emitting diode (LED) module is disclosed. The LED module includes a plurality of LED strings each including a plurality of LEDs in a serial connection with each other and disposed with respect to a central axis of a base board in a co-axial fashion, a plurality of drivers each connected to the corresponding LED string for providing adjustable driving currents to trigger each of the LED strings respectively and to adjust a color temperature of each of the LED strings, and a controller, connected to the plurality of drivers, for generating a plurality of output signals and outputting the output signals to the plurality of drivers respectively in response to a predetermined setting so as to adjust the color temperature.

17 Claims, 4 Drawing Sheets

LED LAMP APPARATUS AND METHOD FOR ADJUSTING COLOR TEMPERATURE OF LED MODULE THEREIN

BACKGROUND OF THE INVENTION

1. Field of the Invention

The present invention relates to a LED lamp apparatus, in particular, to a color temperature adjustable LED lamp apparatus, and a method for adjusting the color temperature of a LED module in the LED lamp apparatus.

2. Description of Related Art

The color temperature of conventional light sources such as sodium lamps, energy-saving bulbs, high-pressure mercury lamps or the like is in a range of 1500K to 7000K. With the advancement of technology and the raising in the awareness of energy saving and carbon reduction, light-emitting diodes (LED) having better light-emitting efficiency and lower electricity consumption have been gaining the popularity in lightings.

A conventional LED lamp device utilizes numerous LEDs capable of emitting a white light. The color temperature of the current white-light LED is in a range of 2700K to 7000K. However, when operating at the lower color temperature the white-light LED is widely perceived not ideal in light-emitting efficiency and mass production. Thus, the white-light LED is generally used as a high color temperature light source. Although the light emitted by the high color temperature light source is brighter, it is not as soft as the light emitted by the lower color temperature light source. Thus, when a special effect or atmosphere is needed, the lower color temperature light source is preferred. However, if the manufacturer intends to make a white-light LED of a lower range of color temperature, the fluorescent powders used may cause a deduction in light-emitting efficiency and reliability, therefore reducing the yield, increasing the production cost, and limiting the application range in the white-light LED.

SUMMARY OF THE INVENTION

A light emitting diode (LED) module is disclosed. The LED module includes a plurality of LED strings each including a plurality of LEDs in a serial connection with each other and disposed with respect to a central axis of a base board in a co-axial fashion, a plurality of drivers each connected to the corresponding LED string for providing adjustable driving currents to trigger each of the LED strings respectively and to adjust a color temperature of each of the LED strings, and a controller, connected to the plurality of drivers, for generating a plurality of output signals and outputting the output signals to the plurality of drivers respectively in response to a predetermined setting so as to adjust the color temperature.

Therefore through the aforementioned technical proposals of the present invention, the following efficacy is achieved: the driving currents used to trigger the plurality of LED strings connected in parallel are adjustable in response to the predetermined setting, thereby adjusting the color temperature of the LED lamp apparatus; furthermore, a sum of the driving currents distributed to the LED strings has a consistent current value, such that the overall power consumption of the LED lamp apparatus may remain consistent as the color temperature adjustment is in process.

In order to further understand the techniques, means and effects the present invention takes for achieving the prescribed objectives, the following detailed description and included drawings are hereby referred, such that, through which, the purposes, features and aspects of the present invention can be thoroughly and concretely appreciated; however, the included drawings are provided solely for reference and illustration, without any intention to be used for limiting the present invention.

DETAILED DESCRIPTION OF THE PREFERRED EMBODIMENTS

The present invention primarily modifies the driving currents passing thru the LED strings and maintains the overall power consumption in a consistent value, so as to achieve the object of adjusting color temperature of the LED lamp apparatus for different purposes in applications. Moreover, the configurations of LEDs contained in the LED strings are specifically designed for illuminating uniformly.

Figure 1:
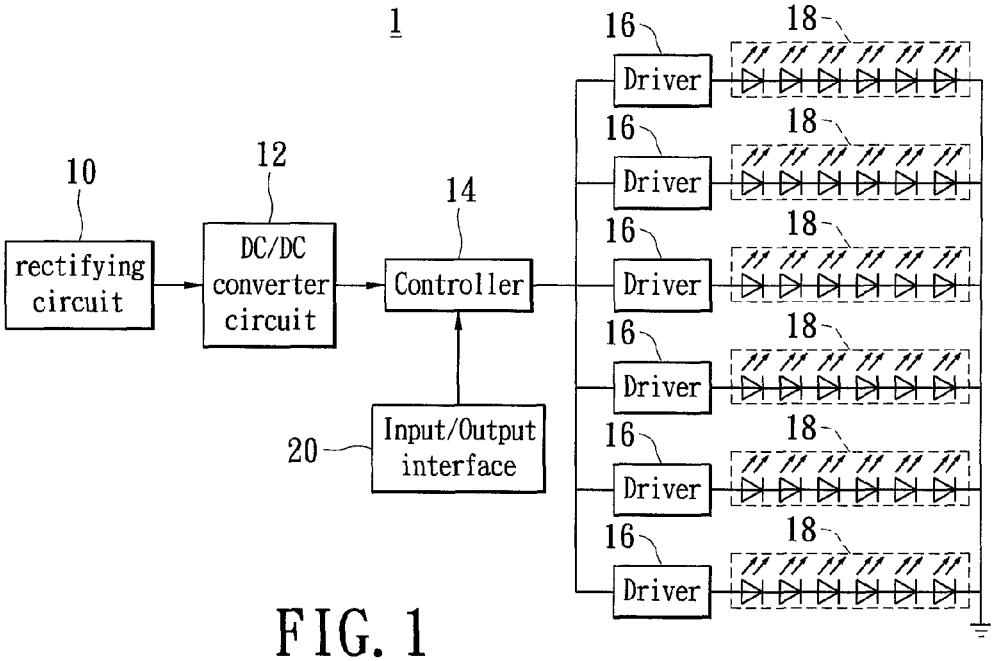
FIG. 1 illustrates a block diagram of a LED module in accordance with certain aspects of the present technique.

Please refer to FIG. 1, in which a block diagram of a LED module in accordance with certain aspects of the present technique is demonstrated. A LED module 1 comprises a rectifying circuit 10, a direct current (DC)/DC converter circuit 12, a controller 14, a plurality of drivers 16, a plurality of LED strings 18, and an input/output interface 20. The LED strings further include a plurality of LEDs 181 connected in series.

The rectifying circuit 10 is used to receive an alternating current (AC) power signal from a power source, e.g. a public electrical power distribution system, and rectify the AC power signal to a rectification signal. The DC/DC converter circuit 12, connected between the rectifying circuit 10 and the controller 14, converts the rectification signal so as to generate a DC signal, and transmits the DC signal to the controller 14. The controller 14, connected to the drivers 16, receives the DC signal, generates a plurality of output signals, and transmits the output signals to the drivers 16 respectively in response to a predetermined setting. The plurality of drivers 16, connected between the controller 14 and the LED strings 18, each of which includes a plurality of LEDs 181 connected in series, provide driving currents to trigger the LED strings 18 respectively according to the output signals received. The predetermined setting stored in the controller 14 has a default value initially; however, the predetermined setting may be adjustable and such adjustment may ne enabled through the input/output interface 20. When the predetermined setting is adjusted, a different signal indicative of such adjustment may cause the controller 14 to output different output signals to the drivers 16, which in turn output different driving currents to the LED strings 18 in order to adjust the color temperatures of the LED module.

That the embodiment shown in FIG. 1 with six LED strings 18 and each LED string 18 contains six LEDs 181 is merely for illustration. In one implementation, three LED strings 18 may include LEDs 181 with color temperature of 2,800K and the other three LED strings 18 may include LEDs 181 with color temperature of 7,000 k. Thus, the controller 14 may output six outputs signals to the six LED strings 18. The six outputs signals may be in a binary form with "1" or "0" standing for "on" or "off," respectively. For example, when the predetermined setting is 7,000 k the output signals of "1" may be transferred to trigger the three drivers 16 connected in series to the LED strings 18 with color temperature of 7,000 k, for outputting the driving currents to the LED strings 18. Meanwhile, the output signals of "0" are transferred to trigger the other three drivers 16 connected in series to the LED strings 18 with color temperature of 2,800 k, for outputting no driving currents to the LED strings 18, so that the color temperature of the LED module 1 could be at 7,000 k.

Moreover, since a current outputted from the controller 14 is of a constant value a summation of values of the driving currents may remain substantially the same despite the predetermined setting could be adjustable. The value of the driving current is determined according to the output signal generated from the controller 14. In the preferred embodiment shown in FIG. 1, a current, e.g., 1,050 mini amperes (mA), is delivered to the controller 14. The controller 14 is configured to output different output currents of values in total equal to 1050 mini amperes. For example, when the predetermined setting of color temperature is 2,800 k, three driving currents, each of which is of 350 mA, are transferred to the LED strings 18 with the color temperature of 2,800 k while no driving current (0 mA) may be transferred to the LED strings 18 with the color temperature of 7,000 k.

When the predetermined setting has been adjusted to another color temperature, e.g., 3,500 k, the driving currents of 175 mA may be transferred to not only the LED strings 18 with the color temperature of 2,800 k, but also the LED strings 18 with the color temperature of 7,000 k.

Furthermore, while the predetermined setting has been adjusted to another color temperature, e.g. 5,000 K, the driving currents of 150 mA may be transferred to the LED strings 18 with the color temperature of 2800 K, and meanwhile, the driving currents of 200 mA may be transferred to the LED strings 18 with color temperature of 7,000 k. In response to the alternation of the driving currents transferring to each LED string, the intended color temperature of the LED module 1 may be attained. The values of the driving currents allocated to the LED strings 18 with the color temperature of 2800 K may not be the same as that of the LED strings 18 with the color temperature of 7,000 k. It is worth to mention that the values of the driving currents of the above-mentioned embodiments are for illustrations, but not limited thereto.

The LED string 18 may be composed of a variety of LEDs 181 with different color temperatures, so that the range of the overall color temperature of the LED module 1 may be wider. It is worth mentioning that the overall power consumption of the LED module 1 according to the present invention remains substantially the same regardless of the modifications to the predetermined setting since the summation of the values of the driving currents remains unchanged. In other words, the overall power consumption of the LED module 1 remains unchanged even with different color temperatures.

Figure 1A:
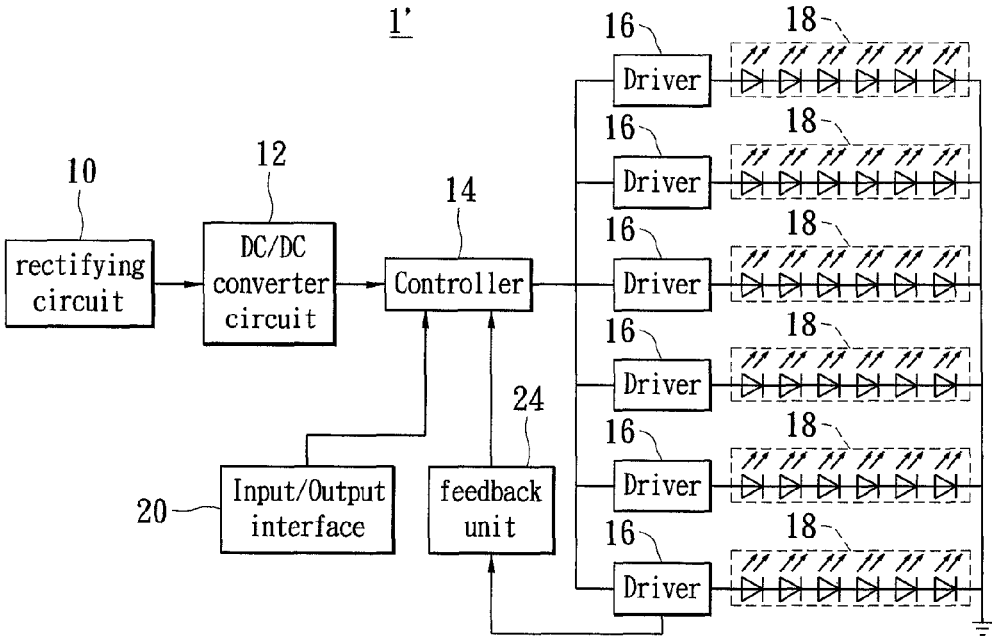
FIG. 1A illustrates a block diagram of a LED module in accordance with certain aspects of the present technique.

In conjunction with FIG. 1, please refer to FIG. 1A in which a block diagram of a LED module in accordance with certain aspects of the present technique is demonstrated, a LED module control system 1' may also include a feedback unit 24, connected between the plurality of drivers 16 and the controller 14, for detecting the driving currents from the drivers 16 and sending back a feedback signal to the controller 14, for modulating the output signals.

Figure 2:
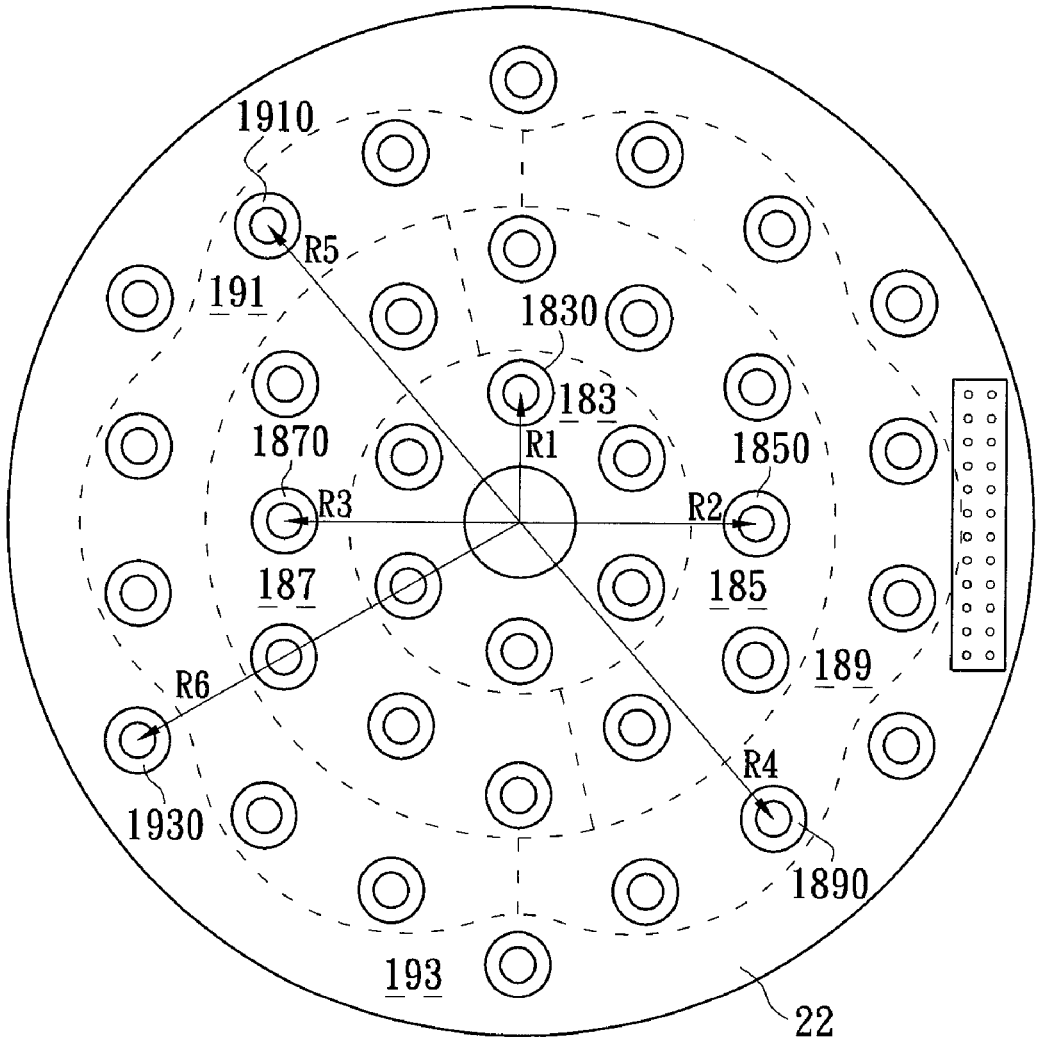
FIG. 2 illustrates a schematic diagram of a first embodiment of a LED lamp apparatus according to one embodiment of the present invention.

Please refer to FIG. 2, in which a schematic diagram of a first embodiment of a LED lamp apparatus according to one embodiment of the present invention is demonstrated. A LED lamp apparatus 3 comprises a base board 22 and a plurality of LED strings 18'. The LED strings 18' are composed of a plurality of LEDs connected in series, and the LEDs are disposed co-axially with respect to a central axis of the base board 22. In FIG. 2, the LED strings 18' include a first LED string 183, a second LED string 185, a third LED sting 187, a fourth LED string 189, a firth LED string 191, and a sixth LED string 193. Each LED string may have 6 LEDs connected in series.

The LEDs 1830 of the first LED string 183 are disposed in a conaxial fashion at a peripheral that is a first radius $R_1$ away from the central axis. The LEDs 1850 of the second LED string 1850 are disposed at a peripheral that is a second radius $R_2$ from the central axis in the co-axial manner and the first radius $R_1$ is shorter than the second radius $R_2$. The LEDs 1870 of the third LED string 187 are disposed at a peripheral that is third radius $R_3$ from the central axis in the co-axial manner wherein the second radius $R_2$ equals to the third radius $R_3$. The LEDs 1890 of the fourth LED string 189 are disposed in the co-axial manner at a peripheral that is a fourth radius $R_4$ from the central axis and the LEDs 1910 of the fifth LED string 191 are disposed at a fifth radius $R_5$ from the central axis co-axially, wherein the fourth radius $R_4$ equals to the fifth radius $R_5$ and is longer than the second radius $R_2$ and the third radius $R_3$. Finally, the LEDs 1930 of the sixth LED strings 193 are disposed at a peripheral that is a sixth radius $R_6$ from the central axis co-axially, and the sixth radius $R_6$ is longer than the fourth radius $R_4$ and the fifth radius $R_5$.

In the embodiment, the first LED string 183, the fourth LED string 189, and the fifth LED string 191 are composed of a plurality of LEDs 1830, 1890, 1910 with the color temperature of 2,800 K. The second LED string 185, the third LED string 187, and the sixth LED string 193 are composed of the plurality of LEDs 1850, 1870, 1930 with the color temperature of 7,000 K. The aforementioned configuration of the LED strings is applied to enhance the illumination uniformity of the LED module 1, so that better illumination uniformity with respect to the predetermined color temperature may be achieved.

Figure 3:
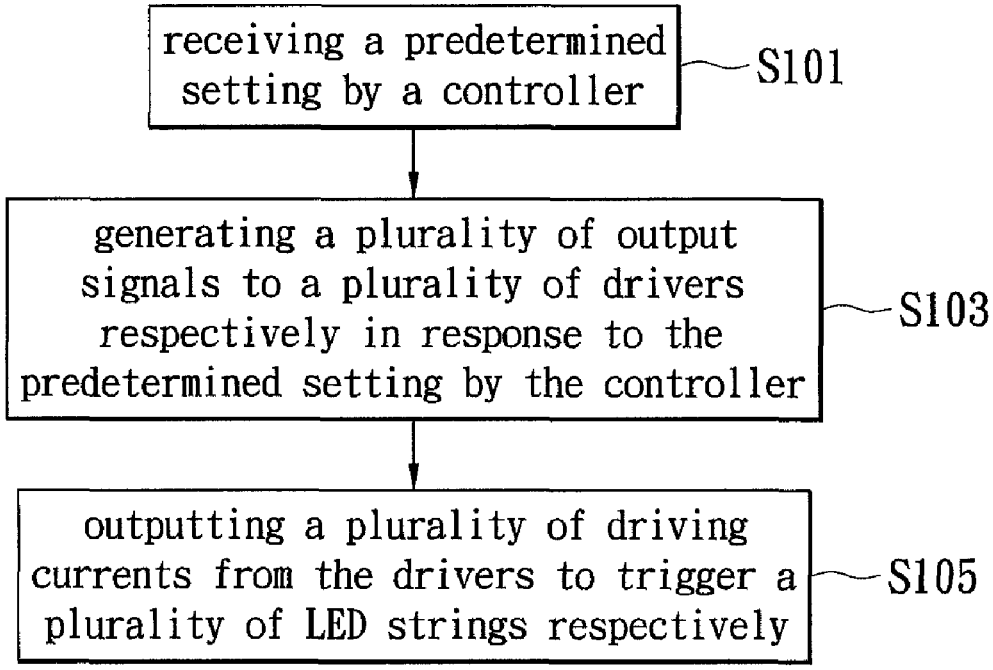
FIG. 3 illustrates a flowchart of a method for adjusting a color temperature according to one embodiment of the present invention.

Next is the further explanation of a method for adjusting a color temperature of a LED lamp apparatus, please refer to FIG. 3 in conjunction with FIG. 1. The method shown in FIG. 3 includes steps discussed in the subsequent paragraphs.

In step S101, a controller of the LED lamp apparatus is configured to read a predetermined setting of a color temperature stored in the controller or receive a signal indicative of an adjusted predetermined setting of the color temperature. In step S103, the controller generates a plurality of outputs signals and outputs them to a plurality of drivers. In step S105, the drivers are able to output a plurality of driving currents corresponding to the received output signals to a plurality of LED strings connected in series. The driving current is used to trigger the LED string to emit light. The higher driving current may correspond to the brighter the LED string.

Figure 4:
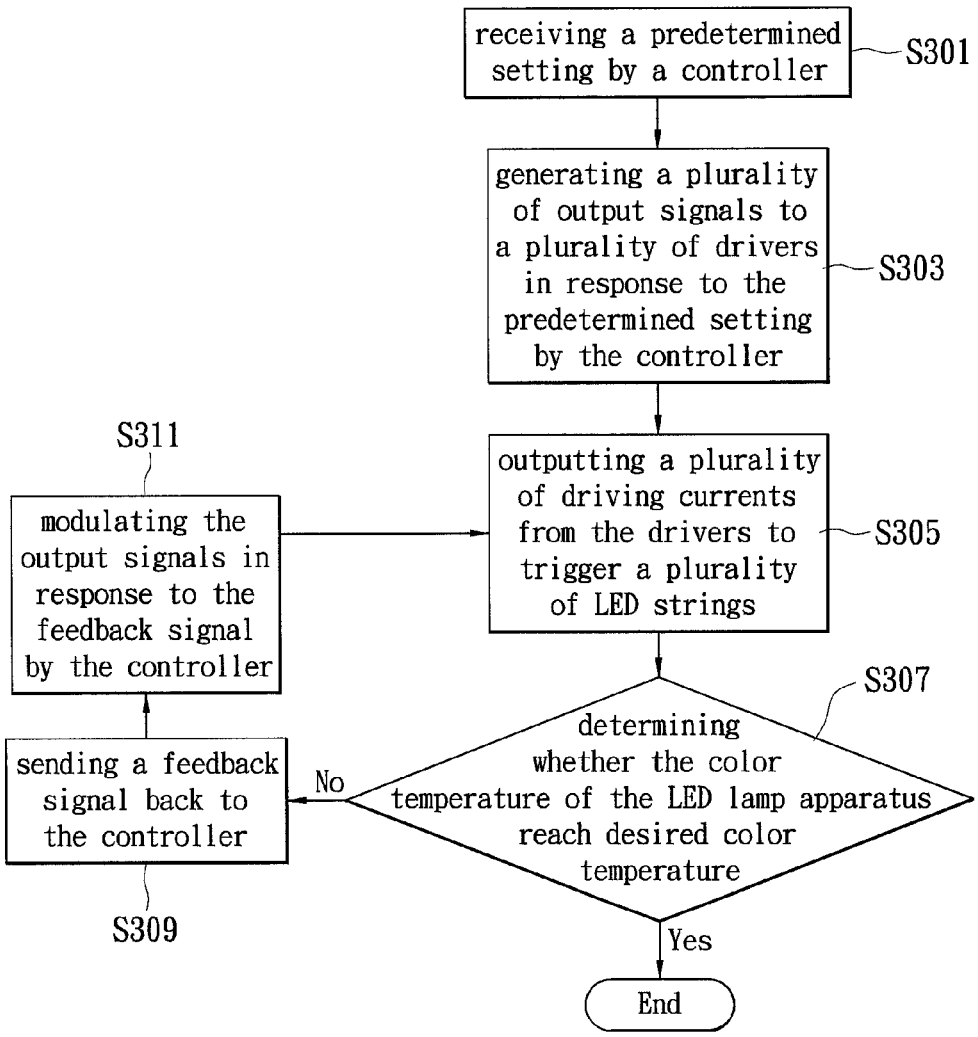
FIG. 4 illustrates a flowchart of a method for adjusting a color temperature according to one embodiment of the present invention.

Furthermore, the method may further include a feedback process to ensure the color temperature is adjusted to the desired level as indicated by the adjusted predetermined setting. Please refer to FIG. 4 in which a flow chart of a method for adjusting color temperature according to one embodiment of the present invention is described. The method illustrated in FIG. 4 includes the steps S301 to 5305 same as the steps S101 to S105 in FIG. 3. The method further includes determining whether the color temperature of the LED lamp apparatus has reached the desired color temperature in step S307.

If so, the feedback loop is end. Otherwise, a feedback signal is sent back to the controller in step S309 and thus in step S311, the controller may modulate the output signals generated in response to the feedback signal according to the predetermined setting or the adjusted predetermined setting. Thereafter, the method may repeat the same steps S305 to S307.

In the aspects of the aforementioned embodiments, the technical characteristics of the present invention is that the driving current generated from the driver is delivered to each loop of LED string, to trigger the LEDs in the LED string wherein the value of the driving current may vary with respect to different predetermined settings for the color temperature. Since the current received from the controller is substantially the same, the summation of the driving currents are substantially the same as well, so that the overall power consumption of the LED module may remain unchanged even with different color temperature requirements. The LEDs in the LED strings are disposed with respect to the central axis of the base board in a co-axial manner.

The aforementioned descriptions represent merely the preferred embodiment of the present invention, without any intention to limit the scope of the present invention thereto. Various equivalent changes, alterations, or modifications based on the claims of present invention are all consequently viewed as being embraced by the scope of the present invention.

What is claimed is:

1. A light emitting diode (LED) module, comprising:

a plurality of LED strings each including a plurality of LEDs in a serial connection with each other wherein the LED strings are disposed with respect to a central axis of a base board in a co-axial fashion;

a plurality of drivers each connected to the corresponding LED string, for providing adjustable driving currents to trigger each of the LED strings respectively and to adjust a color temperature of each of the LED strings; and a controller, connected to the plurality of drivers, for generating a plurality of output signals and outputting the output signals to the plurality of drivers respectively in response to a predetermined setting so as to adjust the color temperature.

2. The LED module according to claim 1, further including:

a rectifying circuit, for rectifying an alternating current (AC) power signal to generate a rectification signal; and a direct current (DC)/DC converter circuit, connected between the rectifying circuit and the controller, for converting the rectification signal to generate a DC signal, and inputting the DC signal to the controller;

wherein the controller is configured to receive the DC signal in order to drive the plurality of drivers in response to the predetermined setting.

3. The LED module according to claim 1, wherein the predetermined setting is a default setting stored in the controller for determining each output signal transmitted to each of drivers respectively so as to control each driving current of each driver.

4. The LED module according to claim 1, wherein a summation of values of the driving currents remains substantially the same.

5. The LED module according to claim 4, wherein the value of the driving current ranges from 0 mini ampere (mA) to 350 mA.

6. The LED module according to claim 1, further comprising an input/output interface, coupled to the controller, enabling a modification of the predetermined setting.

7. The LED module according to claim 1, wherein an overall power consumption of the LED module remains substantially the same.

8. The LED module according to claim 7, wherein the LED strings are associated with different color temperatures.

9. The LED module according to claim 1, further including a feedback unit, connected between the plurality of drivers and the controller, for detecting each of the driving currents before sending back a feedback signal to the controller.

10. A (light emitting diode) LED lamp apparatus, comprising:

a base board; and a LED module having a plurality of LED strings each including a plurality of LEDs connected in series, a plurality of drivers each connected to the corresponding LED string, and a controller connected to the drivers, wherein the LED strings are disposed co-axially with respect to a central axis of the base board;

wherein the driving current outputted by the drivers and transmitted to the LED string according to a predetermined setting corresponds to an adjustable color temperature.

11. The LED lamp apparatus according to claim 10, wherein the plurality of LED strings of the LED lamp apparatus are associated with different color temperatures.

12. The LED lamp apparatus according to claim 10, wherein a summation of values of the driving currents remains substantially the same.

13. The LED lamp apparatus according to claim 10, wherein the color temperature ranges from 2,800K~7,000K.

14. The LED lamp apparatus according to claim 10, wherein an overall power consumption of the LED lamp apparatus remains substantially the same.

15. A method for adjusting a color temperature of a (light emitting diode) LED module in a LED lamp apparatus, comprising the steps of:

receiving a signal indicative of a predetermined setting by a controller;

generating a plurality of output signals to a plurality of drivers respectively in response to the predetermined setting by the controller; and outputting a plurality of driving currents to a plurality of LED strings in the LED module for adjusting the color temperature thereof wherein the LED strings are disposed with respect to a predetermined axis in a co-axially fashion with respect to a base board of the LED module.

16. The method according to claim 15, further including the steps of:

determining whether the color temperature of the LED module reaches a predetermined color temperature associated with the predetermined setting; and sending a feedback signal back to the controller.

17. The method according to claim 16, further including the steps of:

modulating the output signals to the drivers respectively in response to the feedback signal.

* * * * *